US007717974B2

(12) United States Patent
Diepolder et al.

(10) Patent No.: US 7,717,974 B2
(45) Date of Patent: May 18, 2010

(54) AIR FILTER ARRANGEMENT FOR AN INTERNAL COMBUSTION ENGINE

(75) Inventors: Daniel Diepolder, Stuttgart (DE); Eberhard Bohnaker, Leutenbach (DE); Arne Jensen, Langen (DE)

(73) Assignee: Andreas Stihl AG & Co. KG (DE)

( * ) Notice: Subject to any disclaimer, the term of this patent is extended or adjusted under 35 U.S.C. 154(b) by 536 days.

(21) Appl. No.: 11/689,859

(22) Filed: Mar. 22, 2007

(65) Prior Publication Data

US 2007/0220848 A1 Sep. 27, 2007

(30) Foreign Application Priority Data

Mar. 24, 2006 (DE) ..... 10 2006 013 602

(51) Int. Cl.
*F02M 17/34* (2006.01)

(52) U.S. Cl. ..... 55/385.3; 55/385.1; 55/462; 55/DIG. 28; 55/DIG. 30; 123/198 E

(58) Field of Classification Search ..... 55/385.1, 55/385.3, 462, DIG. 28, DIG. 30; 123/198 E; 180/219, 225, 226
See application file for complete search history.

(56) References Cited

U.S. PATENT DOCUMENTS 4,594,083 A * 6/1986 Hiraizumi ..... 55/385.3
4,600,418 A * 7/1986 Gommel et al. ..... 55/462
4,834,784 A * 5/1989 Bidanset ..... 55/385.7
4,838,909 A * 6/1989 Bidanset ..... 55/385.7
5,503,649 A 4/1996 Nickel
5,582,146 A * 12/1996 Linsbauer et al. ..... 123/198 E
6,328,288 B1 12/2001 Gerhardy
6,454,823 B2 * 9/2002 Fries et al. ..... 55/385.3
7,438,738 B2 * 10/2008 Uneta et al. ..... 55/385.3

* cited by examiner

*Primary Examiner*—Duane Smith
*Assistant Examiner*—Minh-Chau T Pham
(74) *Attorney, Agent, or Firm*—Robert W. Becker; Robert Becker & Assoc.

(57) ABSTRACT

An air filter arrangement for an internal combustion engine, especially for a two-cycle engine in a manually guided implement such as a power saw, a cut-off machine, etc., and including an air filter element that delimits a first clean chamber. The air filter arrangement has an inlet opening for an air channel and an inlet opening for a mixture channel. A shield is provided for shielding the air filter element relative to the mixture channel. The inlet opening of the air channel and the inlet opening of the mixture channel are interconnected via the shield.

18 Claims, 3 Drawing Sheets

AIR FILTER ARRANGEMENT FOR AN INTERNAL COMBUSTION ENGINE

The instant application should be granted the priority date of Mar. 24, 2006 the filing date of the corresponding German patent application 10 2006 013 602.0.

BACKGROUND OF THE INVENTION

The present invention relates to an air filter arrangement for an internal combustion engine, in particular for the two cycle engine of a manually guided implement such as a power saw, a cut-off machine, or the like.

U.S. Pat. No. 6,328,288 B1 discloses a carburetor having an air filter, with a mixture channel and an air channel opening out at the base of the air filter. U.S. Pat. No. 5,503,649 A furthermore discloses disposing shield elements between the inlet opening of the mixture channel and the filter element for retaining fuel that pulses back out of the mixture channel, thus preventing contamination of the air filter.

With air filter arrangements where an air channel and a mixture channel communicate with the clean chamber of the air filter, the channels are customarily disposed on the air filter in such a way that no fuel can pass into the air channel from the mixture channel.

It has been shown that at low speeds, a considerable portion of the fuel passes back into the air filter from the mixture channel due to the pulsations in the mixture channel. This fuel is not available for the combustion, and thereby results in a leaner mixture in the combustion chamber of the internal combustion engine. This impairs the operating behavior of the internal combustion engine.

It is an object of the present invention to provide an air filter arrangement for an internal combustion engine that also at low speeds enables a good operating behavior.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
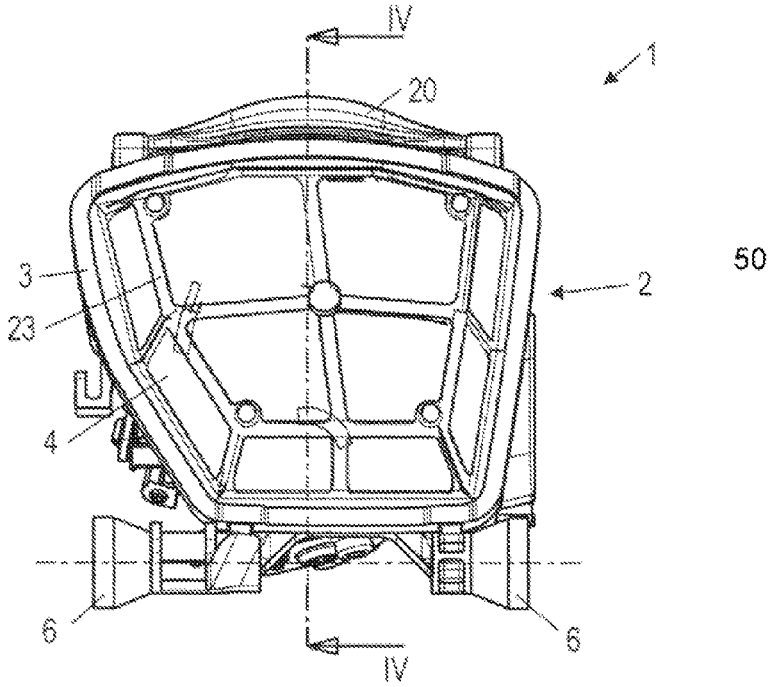
FIG. 1 is a side view of one exemplary embodiment of an air filter arrangement.

The air filter arrangement of the present application comprises an air filter element that delimits a first clean chamber, with an inlet opening being provided for an air channel and an inlet opening being provided for a mixture channel; a shield is provided for shielding the air filter element relative to the mixture channel, wherein the inlet opening of the air channel is in communication with the inlet opening of the mixture channel via the shield.

Instead of providing as good a separation of the air channel and the mixture channel as possible, as has been previously provided, and also preventing fuel in the air filter from passing into the air channel, it is proposed pursuant to the present invention that the inlet openings of the air channel and of the mixture channel be deliberately connected to one another via the shield. By means of this connection or communication, it is possible, in particular at low speeds, in other words when relatively large quantities of fuel pass into the air filter, for the fuel from the air filter to also pass into the air channel. Thus, at low speeds fuel is supplied not only via the air channel but also via the mixture channel. Consequently, a significant leaning of the mixture in the combustion chamber of the internal combustion engine is avoided at low speeds. At high speeds, the pulsations are less strong in the mixture channel, so that here essentially no fuel passes into the air filter. At high speeds, largely fuel-free air is thereby supplied via the air channel, whereby this fuel-free air can serve for scavenging where provided for. As a result, low emission values are achieved at high speeds. The shield simultaneously prevents contamination of the air filter from fuel that has passed out of the mixture channel into the air mixture.

The shield delimits a second clean chamber that is connected with the first clean chamber by means of at least one communication opening, wherein the inlet openings of the air channel and the mixture channel respectively open into the second clean chamber. Due to the fact that the inlet openings of both channels open into a second clean chamber, it is possible for the fuel that passes back into the air filter to pass nearly entirely to the internal combustion engine, whereby no fuel can pass into the first clean chamber and to the air filter.

The shield advantageously extends the mixture channel and the air channel up to the communication opening. At low speeds, often insufficient fuel and combustion air can be supplied to the internal combustion engine. It has been shown that for an adequate filling of the air channel and of the mixture channel, the channel lengths that are available are critical. An extension of these channels effects an improvement of the filling, whereby in particular resonance characteristics of the channels should also be taken into account. Due to the fact that the mixture channel and the air channel are extended by the shield, it is possible to achieve extended channel lengths in a simple manner where the installation space is small. By the provision of the communication opening in the shield, it is possible to achieve a coordination of the channel lengths. As a result, it is also possible to adapt an air filter arrangement to an internal combustion engine simply by exchanging the shield. It is also possible in a straightforward manner to achieve a good degree of filling of the channels, and an adequate supply of the internal combust ion engine with fuel and combustion air.

The shield advantageously has a bulged portion that extends over the inlet opening of the mixture channel. Fuel that has passed over out of the mixture channel can collect in the bulged portion, and from there can again be guided back into the mixture channel via the combustion air that is drawn in. The shield advantageously has a channel-like connecting portion that extends from the inlet opening of the mixture channel to the inlet opening of the air channel, and by means of which the air channel and the mixture channel are interconnected. The connecting portion ensures that at low speeds fuel can also pass out of the mixture channel into the air channel. The fuel supplied via the air channel prevents an excessive leaning of the fuel/air mixture in the combustion chamber. In addition, the fuel in the air channel effects a cleaning of a throttle element, for example an air valve or choke, that is disposed in the air channel. Thus, an ability of the throttle element in the air channel to be able to close well can also be ensured over long periods of operation. By adapting the length of the connecting portion, the ratio of the lengths of the channels to one another can be altered. In this way, it is possible to coordinate the resonances of the channel lengths. The channel-like connecting portion expediently adjoins the bulged portion.

The shield can have a transverse portion that adjoins the channel-like connecting portion and extends transverse thereto. The transverse portion advantageously extends at least partially over the inlet opening of the air channel. The transverse portion expediently has a top portion in which is disposed at least one communication opening. The fuel that has passed into the air filter collects at the top portion, thereby extensively avoiding passage of the fuel into the first clean chamber. The top portion is advantageously disposed on that side of the transverse portion that faces away from the connecting portion. As a result, a relatively large spacing is achieved between the communication opening and the inlet opening of the mixture channel. At least one communication opening is advantageously disposed on that side of the inlet opening of the air channel that faces away from the inlet opening of the mixture channel. Also thereby is it possible to largely prevent passage of fuel into the first clean chamber.

At least one guide surface can be disposed on the shield adjacent to the inlet opening of the air channel; this guide surface conveys retained fuel to the inlet opening of the mixture channel. The inlet opening of the air channel, relative to the effective direction of the force of gravity, is advantageously, in a customary installation position of the air filter arrangement, disposed above the inlet opening of the mixture channel. As a result, the force of gravity contributes to prevent fuel from being able to pass out of the second clean chamber into the first clean chamber. The air filter element in particular extends over the shield in a dome-like manner.

Further specific features of the present application will be described in detail subsequently.

DESCRIPTION OF SPECIFIC EMBODIMENTS

Figure 2:
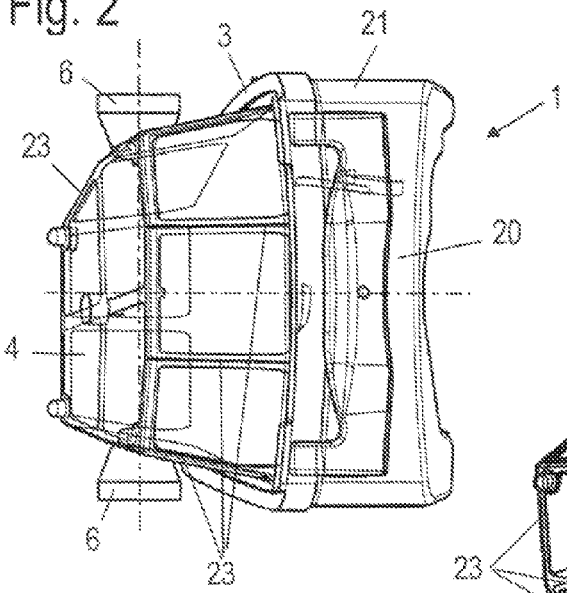
FIG. 2 is a plan view of the air filter arrangement of FIG. 1.
Figure 3:
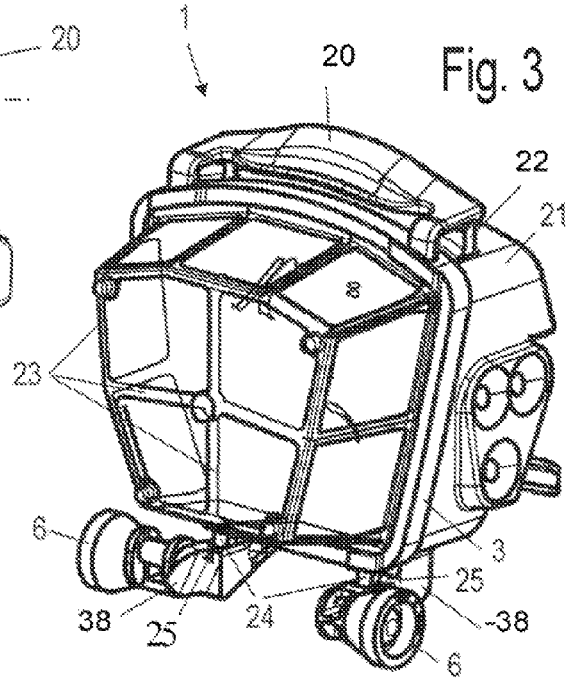
FIG. 3 is a perspective illustration of the air filter arrangement of FIG. 1.

Referring now to the drawings in detail, FIGS. 1 to 3 show an air filter arrangement 1 for an internal combustion engine, especially for a two-cycle engine in a manually guided implement such as a power saw, a cut-off machine a brushcutter, or the like. The air filter arrangement 1 comprises an air filter 2 having an air filter frame 3 on which is disposed a filter element 4. The filter element 4 spans the flat air filter frame 3 in a dome-like manner, and is supported on struts 23, which form a lattice, the lattice openings of which are covered by the filter element 4.

Disposed on the air filter frame 3 is a grip element 20 that cooperates with snap-fit connectors 22 on the air filter housing 21. On the opposite side of the frame 3 tabs 24 are provided on the frame 3 that extend into receiving means 25 formed on the air filter housing 21. The air filter 2 is fixed on the air filter housing 21 by means of the tabs 24 and the grip element 20. By releasing the latching or engagement by raising the grip element 20, the air filter 2 can be removed from the air filter housing 21, for example for cleaning purposes.

The receiving means 25 are formed on support members 38 that extend on that side of the air filter housing 21 that faces away from the grip element 20. Disposed on each support member 38 is a respective anti-vibration element 6 by means of which the air filter housing 21 is supported against a housing member of the manually-guided implement.

In a customary installed position of the air filter arrangement 1, the grip element 20, as shown in FIG. 1, is disposed at the top relative to the effective direction 50 of the force of gravity, while the anti-vibration elements 6 extend below the air filter 2.

Figure 4:
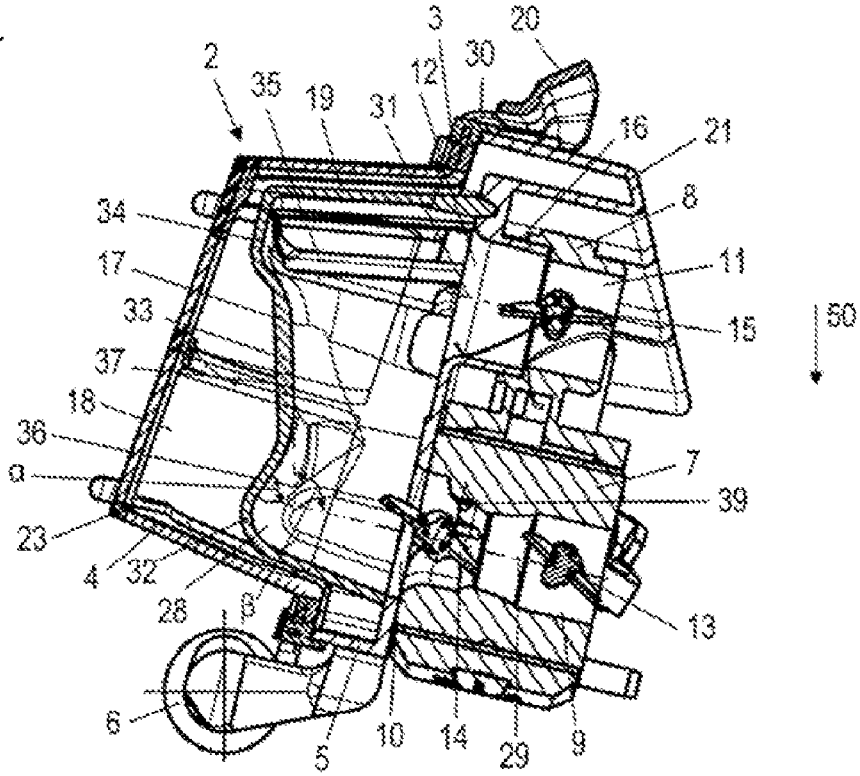
FIG. 4 is a cross-sectional view taken along the line IV-IV in FIG. 1.

FIG. 4 shows a cross-sectional view through the air filter arrangement 1. The air filter housing 21 has an air filter base 5 to which is secured a carburetor 7. A portion of a mixture channel 9 is formed in the carburetor 7. Disposed in the mixture channel 9 is a butterfly valve 13, and upstream thereof a choke valve 14. Opening into the mixture channel 9 is a fuel opening 39 that supplies fuel to the mixture channel 9 as a function of the underpressure or vacuum in the mixture channel. The mixture channel 9 opens into the air filter 2 at an inlet opening 10 that is formed in the air filter base 5.

Supported on the carburetor 7 is an air channel portion 8 in which an air channel 11 is guided. Pivotably mounted in the air channel 11 is a choke or air valve 15. The air channel portion 8 is held on a connector 16 on the air filter base 5. The air channel 11 opens into the air filter 2 via an inlet opening 12 that is formed in the air filter base 5. The mixture channel 9 has a longitudinal axis 29, and the air channel 11 has a longitudinal axis 31.

The air filter 2 delimits a clean chamber 18. The air filter frame 3 has a sealing rim 30 via which it rests upon the air filter housing 21 and thus seals the clean chamber 18 relative to the atmosphere. Disposed in the clean chamber 18 is a shield 17 that extends over the inlet openings 10 and 12 of the mixture channel 9 and the air channel 11 respectively, and delimits a second clean chamber 28 that is disposed in the interior of the first clean chamber 18. In the direction of the longitudinal axis 29 of the mixture channel 9, the shield 17 is disposed between the inlet opening 10 of the mixture channel and the air filter element 4, and in the direction of the longitudinal axis 31 of the air channel 11, the shield 17 is disposed between the inlet opening 12 of the air channel and the air filter element 4.

Figure 5:
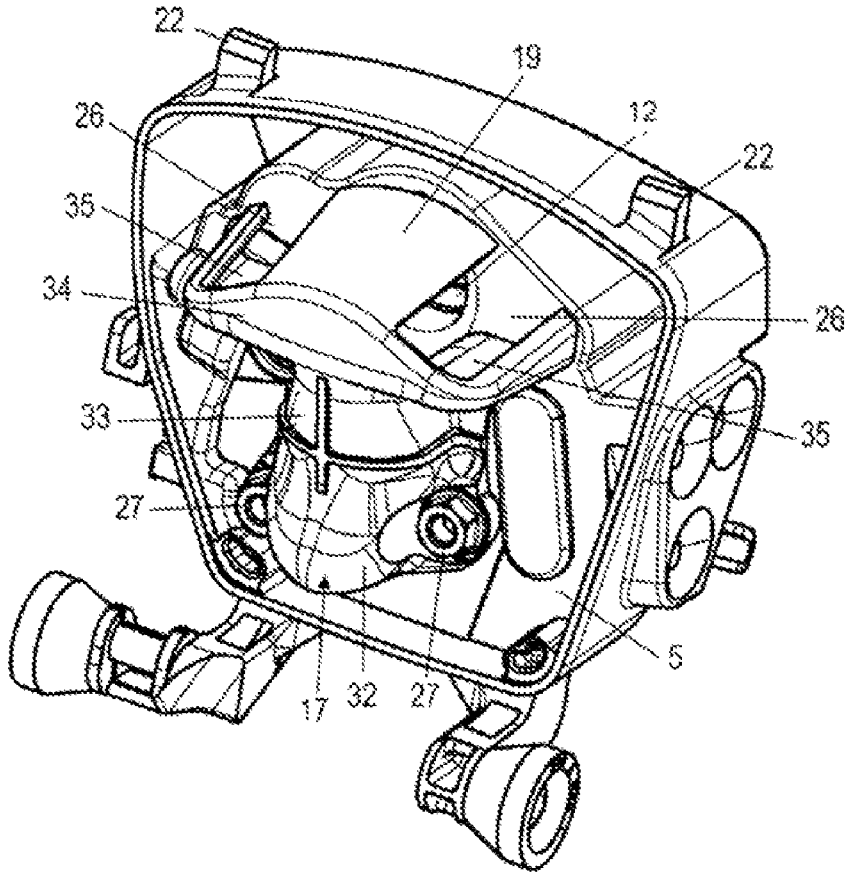
FIG. 5 is a perspective illustration of the air filter arrangement without the filter element.
Figure 6:
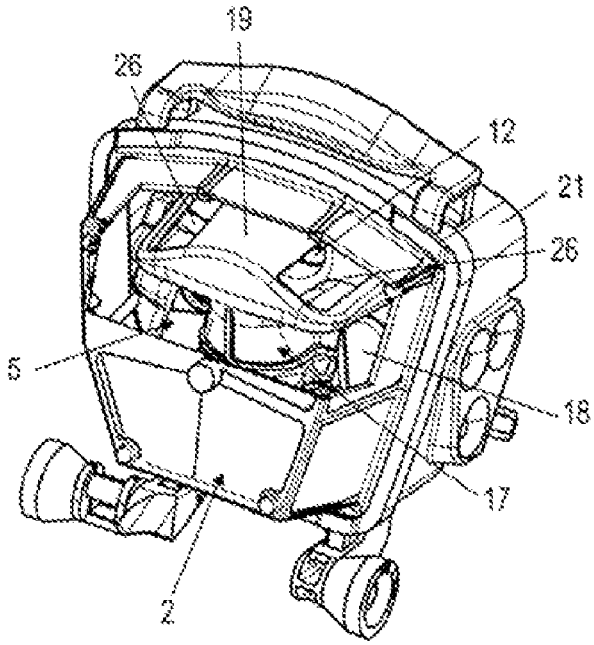
FIG. 6 is a perspective illustration of the air filter arrangement with a partially cut-away air filter element.

As shown in FIG. 4 and in the perspective illustration of FIG. 5, the shield 17 has a bulged portion 32 that extends over the inlet opening 10 of the mixture channel 9, and that on that side that is remote from the inlet opening 12 of the air channel 11 adjoins the air filter base 5. As shown in FIG. 5, the bulged portion 32 also extends along the lateral regions of the inlet opening 10, so that the bulged portion 32 is open only in the direction toward the inlet opening 12 of the air channel 11. At the longitudinal sides of the inlet opening 10, the shield 17 is secured to the air filter base 5 via securement nuts 27.

Adjoining the bulged portion 32 is a channel-like connecting portion 33 that extends between the inlet opening 10 of the mixture channel 9 and the inlet opening 12 of the air channel 11; the connecting portion 33 extends over that region disposed between the two inlet openings 10, 12 in a tunnel-like manner. A transverse portion 34 adjoins the connecting portion 33 approximately at the level of the longitudinal axis 31 of the air channel 11. The bulged portion 32, the connecting portion 33, and the transverse portion 34 form a T-shape, whereby the transverse portion 34 forms the crosspieces of the T.

On that side facing the connecting portion 33, the transverse portion 34 is provided with guide surfaces 35 that are inclined toward the connecting portion 33. On that side remote from the connecting portion 33, the transverse portion 34 is provided with a top portion 19. Formed in the top portion 19, opposite to the guide surfaces 35, are communication openings 26 that connect the first clean chamber 18 with the second clean chamber 28 that is formed in the shield 17. The communication openings 26 are disposed beyond the extension of the connecting portion 33.

As shown in FIG. 4, the rear wall 36 of the bulged portion 32 is inclined relative to the longitudinal axis 29 of the mixture channel 9 by an angle β that is less than 90°. The rear wall 37 of the connecting portion 33 is inclined relative to the longitudinal axis 29 of the mixture channel 9 by an angle α of greater than 90°. As shown in FIG. 4, the top 19 rises toward the inlet opening 12 of the air channel 11. The top 19, the rear wall 37, and the rear wall 36 of the shield 17 thereby conduct condensed or deposited fuel back to the mixture channel 9.

During operation, combustion air is drawn in through the filter element 4 into the first clean chamber 18, from there via the communication openings 26 into the second clean chamber 28, and into the air channel 11 and the mixture channel 9. At low speeds, strong pulsations occur in the mixture channel 9. In particular at high load, in other words when the butterfly valve 13, the choke valve 14 and the air valve 15 are completely opened, relatively large quantities of fuel are flung out of the mixture channel 9 into the bulged portion 32 of the shield 17. There, the fuel is partially deposited or condensed on the walls of the shield 17 and is conveyed back into the mixture channel 9 by the bulged portion 32. A portion of the fuel passes into the air channel 11, in which the fuel effects a cleaning of the air valve. At low speeds fuel is supplied to the internal combustion engine not only via the air channel 11 but also via the mixture channel 9. Further fuel can be deposited on the shield 17 and is conveyed back into the mixture channel 9.

At high speeds the pulsations in the intake channel are relatively low. As a result, at most small quantities of fuel pass into the shield 17. The fuel is deposited essentially in the bulged portion 32, and passes back into the mixture channel 9. At high speeds, no fuel, or at most very small quantities of fuel, are supplied via the air channel 11. As a result, a two-cycle engine having scavenging that is operated by the air filter arrangement 1 can achieve low emission values at high speeds.

The shield 17 extends the mixture channel 9 to the communication openings 26. The air channel 11 is also extended by the flow length between the inlet opening 10 and the communication openings 26. In this connection, the communication openings 26 are disposed in such a way that the overall lengths of the mixture channel and the air channel are coordinated with one another, so that during operation resonance results that leads to a good filling of the channels. As a result, in particular at low speeds, it is possible to achieve an increase of the torque of the internal combustion engine.

To ensure that at high speeds no fuel passes out of the bulged portion 32 and into the air channel 11, the inlet opening 12 of the air channel 11, relative to the effective direction 50 of the force of gravity, is disposed above the inlet opening 10 of the mixture channel 9 and above the bulged portion 32. Due to the force of gravity, the fuel is supplied to the mixture channel 9 and not to the air channel 11. In this connection, the customary installed position of the air filter arrangement 1 relates to the position that results from the customary position during operation. With power saws and cut-off machines, this position corresponds approximately to the position when the implement is set on the ground.

Figure 7:
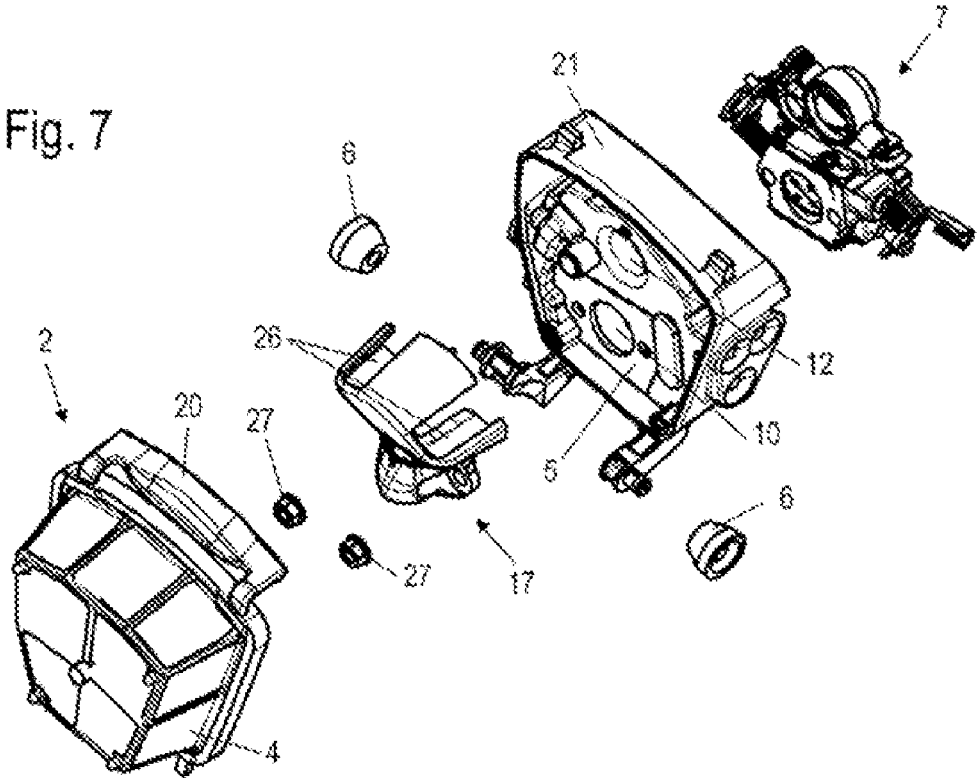
FIG. 7 is an exploded view of the air filter arrangement.

As shown in the exploded view of FIG. 7, the shield 17 is secured to the air filter base 5 via the securement nuts 27. The shield 17 has no contact with other components. The filter element 4 extends over, and is spaced from, the shield 17. To adapt the lengths of the mixture channel 9 and the air channel 11, for example in order to use the air filter arrangement 1 with a different internal combustion engine, the shield 17 can be exchanged. The communication openings 26 can be arranged on the shield 17 in such a way that a good coordination or adaptation of the lengths of the channels results. It is also possible to lengthen the connecting portion 33 for adaptation of the channel lengths, for example by providing the connecting portion 33 with a bend. Additional guide elements could also be provided for altering the channel lengths and/or in order to guide the fuel in a precisely controlled manner.

The air channel and the mixture channel could also be guided in a common channel tube, at least over a portion of their length, and can be separated from one another by a partition.

The specification incorporates by reference the disclosure of German priority document 10 2006 013 602.0 filed Mar. 24, 2006.

The present invention is, of course, in no way restricted to the specific disclosure of the specification and drawings, but also encompasses any modifications within the scope of the appended claims.

What we claim is:

1. An air filter arrangement for an internal combustion engine that operates with scavenging, comprising:

a housing (21) having an air filter base (5), wherein said air filter base (5) is provided with a first inlet opening (12) and a second inlet opening (10), further wherein an air channel (11) opens out at said first inlet opening (12), and wherein a mixture channel (9) opens out at said second inlet opening (10);

an air filter element (4) operatively mounted on said housing (21), wherein said air filter element (4) delimits a first cleaning chamber (18); and a shield (17) disposed in said first cleaning chamber (18) for shielding said air filter element (4) relative to said mixture channel (9), wherein said first inlet opening (12) is adapted to be in communication with said second inlet opening (10) via said shield (17).

2. An air filter arrangement according to claim 1, wherein said shield (17) delimits a second clean chamber (28), wherein said shield (17) has at least one communication opening (26) to connect said first clean chamber (18) and said second clean chamber (28), and wherein said first inlet opening (12) and said second inlet opening (10) open into said second clean chamber (28).

3. An air filter arrangement according to claim 2, wherein said shield (17) extends both said mixture channel (9) and said air channel (11) to said at least one communication opening (26).

4. An air filter arrangement according to claim 1, wherein said shield (17) includes a bulged portion (32) that extends over said second inlet opening (10).

5. An air filter arrangement according to claim 4, wherein said shield (17) includes a channel shaped connecting portion (33) that extends from said second inlet opening (10) to said first inlet opening (12), and wherein said air channel (11) and said mixture channel (9) are adapted to be interconnected via said connecting portion (33).

6. An air filter arrangement according to claim 5, wherein said channel shaped connecting portion (33) adjoins said bulged portion (32).

7. An air filter arrangement according to claim 5, wherein said shield (17) includes a transverse portion (34) that adjoins said channel shaped connecting portion (33) and extends transverse to said connecting portion.

8. An air filter arrangement according to claim 7, wherein said transverse portion (34) extends at least partially over said first inlet opening (12).

9. An air filter arrangement according to claim 7, wherein said transverse portion (34) is provided with a top portion (19) in which is disposed at least one communication opening (26).

10. An air filter arrangement according to claim 9, wherein said top portion (19) is disposed on that side of said transverse portion (34) that faces away from said connecting portion (33).

11. An air filter arrangement according to claim 1, wherein at least one communication opening (26) is disposed on a side of said first inlet opening (12) that faces away from said second inlet opening (10).

12. An air filter arrangement according to claim 1, wherein at least one guide surface (35) is disposed on said shield (17) adjacent to said first inlet opening (12), and wherein said at least one guide surface (35) is adapted to guide retained fuel to said second inlet opening (10).

13. An air filter arrangement according to claim 1, wherein in a customary installation position of said air filter arrangement, and relative to an effective direction (50) of the force of gravity, said first inlet opening (12) is disposed above said second inlet opening (10).

14. An air filter arrangement according to claim 1, wherein said air filter element (4) is adapted to extend over said shield (17) in the manner of a dome.

15. An air filter arrangement according to claim 1, wherein a carburetor (7) is secured to said air filter base (5), and wherein a portion of said mixture channel (9) is formed in said carburetor (7).

16. An air filter arrangement according to claim 1, wherein a fuel opening (39) opens into said mixture channel (9).

17. An air filter arrangement according to claim 1, wherein a choke or throttle element (15) is pivotably disposed in said air channel (11).

18. An air filter arrangement according to claim 1 wherein at low engine speeds, fuel is adapted to be supplied to said internal combustion engine not only via said air channel (11) but also via said mixture channel (9).

* * * * *